US010349470B2

(12) United States Patent
Gough et al.

(10) Patent No.: US 10,349,470 B2
(45) Date of Patent: Jul. 9, 2019

(54) PORTABLE INDUCTION HEATER

(71) Applicant: Sarge Holdings Co., LLC, Elgin, IL (US)

(72) Inventors: Thomas M. Gough, Gilberts, IL (US); Paul G. Astrowski, Carol Stream, IL (US); Lawrence S. Erst, Addison, IL (US); Josh Gore, McHenry, IL (US)

(73) Assignee: Sarge Holdings Company, LLC, Elgin, IL (US)

( * ) Notice: Subject to any disclaimer, the term of this patent is extended or adjusted under 35 U.S.C. 154(b) by 482 days.

(21) Appl. No.: 14/926,278

(22) Filed: Oct. 29, 2015

(65) Prior Publication Data

US 2017/0127481 A1 May 4, 2017

(51) Int. Cl.
*H05B 6/10* (2006.01)
*H05B 6/14* (2006.01)
*H05B 6/36* (2006.01)

(52) U.S. Cl.
CPC ..... *H05B 6/101* (2013.01); *H05B 6/14* (2013.01); *H05B 6/36* (2013.01)

(58) Field of Classification Search
CPC . H05B 6/36; H05B 6/14; H05B 6/101; H05B 6/06; H05B 6/105; H05B 6/40; H05B 6/104; H05B 6/42; H05B 6/04; H05B 6/145; H05B 6/362; H05B 6/44
USPC ..... 219/633, 635, 676, 672, 229, 618, 659, 219/670, 674, 616, 619, 620, 634, 636, 219/645, 660, 662, 665, 673, 677
See application file for complete search history.

(56) References Cited

U.S. PATENT DOCUMENTS

| | | | | |
|---|---|---|---|---|
| 6,205,290 | B1 * | 3/2001 | Hung | F24H 3/002 165/128 |
| 6,376,814 | B2 * | 4/2002 | Holmes | H01C 3/20 219/536 |
| 6,563,096 | B1 | 5/2003 | Pacholok | |
| 6,670,590 | B1 | 12/2003 | Pacholok | |
| 2011/0041457 | A1 * | 2/2011 | Montano | B26D 7/10 53/373.7 |

FOREIGN PATENT DOCUMENTS

| | | | | |
|---|---|---|---|---|
| EP | 2205042 | A1 * | 7/2010 | H05B 6/06 |
| EP | 2608634 | A1 * | 6/2013 | H05B 6/101 |
| EP | 2809127 | A1 * | 12/2014 | H05B 6/14 |

* cited by examiner

*Primary Examiner* — Ibrahime A Abraham
*Assistant Examiner* — Chris Q Liu
(74) *Attorney, Agent, or Firm* — Michael P. Mazza, LLC

(57) ABSTRACT

A portable induction heater with a rotating head portion which can be used to rapidly, detachably connect a work coil. The portable induction heater is also provided with various other advantages detailed here.

12 Claims, 9 Drawing Sheets

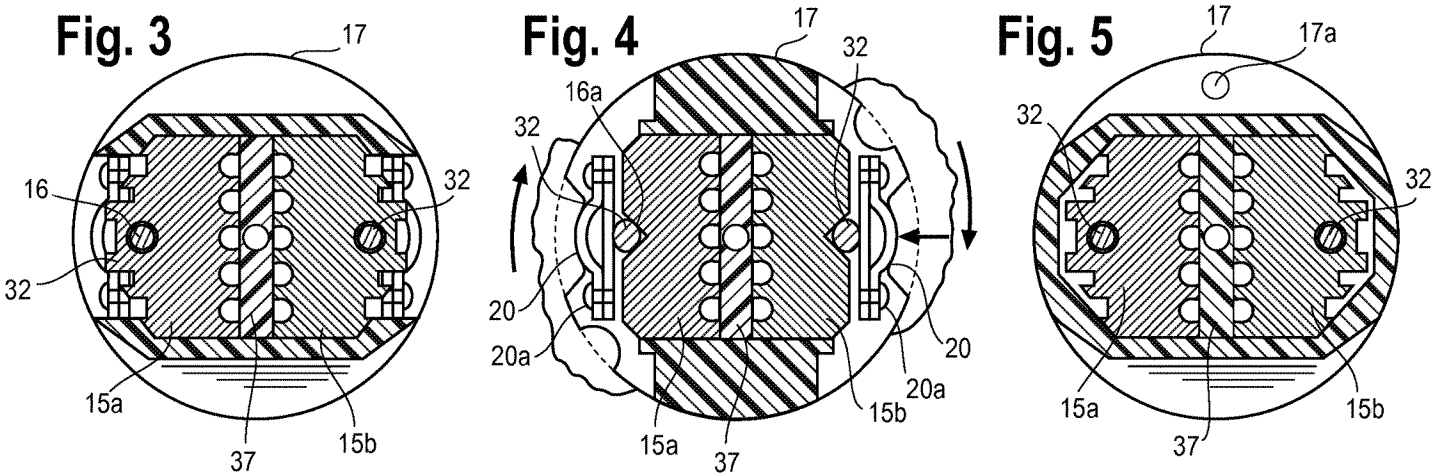
Fig. 3
Fig. 4
Fig. 5
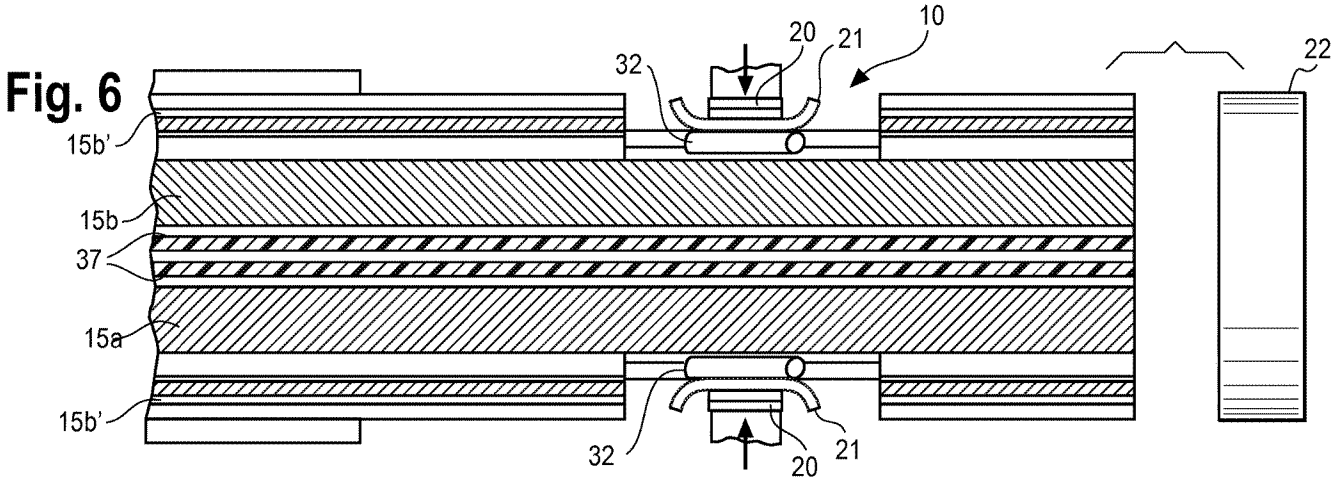
Fig. 6

PORTABLE INDUCTION HEATER

BACKGROUND OF THE INVENTION

The present invention relates to portable handheld induction heaters. Such induction heaters have a variety of uses, such as in the automotive aftermarket for vehicle repair and maintenance, i.e., selectively heating automotive metallic and adjacent components, and removing components bonded or attached to metallic surfaces (e.g., fasteners), or removing structure attached by means of adhesive (e.g., glass). Other uses for such induction heaters include similar, maritime uses, industrial uses such as heating rods to bend them in a fabrication process, annealing ammunition cartridges, etc.

Portable handheld induction heaters useful in the automotive aftermarket are known. See for example, Applicant's U.S. Pat. Nos. 6,563,096 and 6,670,590, titled "Eddy Current/Hysteretic Heater Apparatus And Method Of Use" and "Eddy Current/Hysteretic Heater Apparatus," respectively, each of which is incorporated by reference in its entirety. Applicant's pending U.S. Ser. No. 14/065,844, filed Oct. 29, 2013, titled "Portable Induction Heater," and Ser. No. 14/330,429 filed Jul. 14, 2014, titled "Induction Heater Coil Accessory," disclosing, e.g., handheld induction heaters which can run on power supplied at 12-24 volts, as well as 110-240 volts, and disclosing alternative forms of work coils, respectively, are each hereby incorporated by reference in their entirety.

Induction heaters may be air-cooled or water-cooled. The present invention concerns air-cooled induction heaters. Three main components of a modern induction heater include the power unit (power inverter), optional output/isolation transformer and the coil (inductor). Induction heating is a non-contact method of heating a conductive body by utilizing a strong magnetic field. Induction heaters may incorporate a coil directly fed from the electricity supply. The power unit/inverter is used to take the supply/mains frequency and increase it to a higher frequency, typically anywhere between 1-400 kHz. Typical power output of a unit system may be about 1-500 kW. The work head/transformer may include a combination of capacitors and transformers used to mate the power unit to the work coil. The work coil/inductor is used to transfer the energy from the power unit and work head to the work piece. Inductors of the type of the present invention consist of a simple wound solenoid with a number of turns of copper tube wound around a mandrel.

To work properly, the coil must be placed in close proximity to the work piece (e.g., a nut to be loosened). This can be difficult in tight or difficult to access areas and/or where there are closely adjacent surfaces to the work piece, which the operator does not wish to heat or damage.

A conventional coil configuration used for handheld induction heaters utilizes round conductor wire (e.g., copper), which may be bent into various coil shapes, and which typically have two lead wires or "legs" 32 which may be detachably connected to the induction heater. Work coils typically have circular cross-sections. However, the round wire of work coils may be flattened to provide work coils with semi-circular and rectangular cross-sectional geometries, as has been recently disclosed (see Applicant's U.S. Ser. No. 14/330,429, referenced above).

In the past, the ends or legs of work coils have been attached to the head of a portable induction heater using thumb screws. Thumb screws take a relatively long time to change the work coil, i.e., the user must loosen the two thumb screws, remove the coil legs, insert the coil legs of a different work coil (such as one of a different size and/or shape), and re-tighten the two thumb screws. Thumb screws can loosen over time, as the induction heater is used. The user may not be aware that loosening has occurred, until various conditions occurs, such as: (a) excessive heat develops in the heat dissipating terminal ("HDT"), which can melt the thumb screw cap; or (b) a loose coil creates sparks, which can damage electronics in the induction heater.

Accordingly, it would be advantageous to provide a faster, more reliable method for attaching and detaching the work coil legs to an induction heater. It would also be advantageous to provide a secure attachment device and method which works with work coil legs of different cross-sectional geometries, including circular, semi-circular and rectangular geometries.

Definition of Claim Terms

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"Automotive applications" means applications for selectively heating automotive metallic and adjacent components, and removing components bonded or attached to metallic surfaces (e.g., fasteners), or for removing structure attached by means of adhesive (e.g., glass, parts, components).

"Coil" or "work coil" means the portion of the induction heater used to heat a work piece. This typically is either an open or closed loop permanently attached to and/or integrally formed with the legs; however, a connection, such as an extension cable or a pair of legs attachable to and removable from the induction heater body, may be provided between the coil and the induction heater. Each work coil can be replaced with another work coil, either because of durability concerns or because a differently shaped or sized work coil is desired to be used for a certain application.

"Rapidly" means the substantial time-savings enabled by the present invention, in comparison to the time required to attach and detach the legs of a work coil to a portable induction heater using conventional thumb screws.

SUMMARY OF THE INVENTION

The objects mentioned above, as well as other objects, are solved by the present invention, which overcomes disadvantages of prior portable induction heaters, while providing new advantages not previously obtainable with such heaters.

In a preferred embodiment, a portable induction heater is provided which may be detachably connected to different work coils. Each work coil includes a coil portion and two legs. The induction heater includes a head with a portion capable of limited rotation, and a body which may be held by a hand of a user during use of the induction heater. Upon insertion of the legs of the work coil into apertures on the head, and rotation of the head portion, the legs are thereby locked to the head. The head may include a heat dissipating terminal, and the head portion may include a collar capable of limited rotation about the heat dissipating terminal. Two copper contactors may be provided, each of which is attached to the heat dissipating terminal.

One or more inner surfaces of the collar may be permitted to contact and bend each of the two copper contactors during rotation of the collar, causing each of the two legs of the work coil to be locked in place against each of the two corresponding copper contactors within the head, and providing positive feedback to the user that the legs are locked in place.

In a particularly preferred embodiment, upon limited rotation of the collar, each of the two legs of the work coil may be locked in place between opposing, adjacent surfaces of a corresponding one of each of the two copper contactors.

Preferably, the induction heater is an air-cooled induction heater. The heat dissipating terminal may be made of extruded aluminum.

Non-circular grooves, such as generally V-shaped grooves, on the induction heater may be used to accept the legs of the work coil. The heat dissipating terminal may have fins with serrations, and the non-circular grooves may not have serrations.

The portable induction heater of the invention may be used for automotive, industrial, maritime or other applications.

The portable induction heater may also be provided with an isolation transformer with two legs. Each leg of the isolation transformer may be connected to one of the two copper contactors. The heat dissipating terminal may include two separate portions, which may be separated by a heat sink insulator; each of the two copper contactors may be directly connected to one of the two portions of the heat dissipating terminal.

A method for rapidly, detachably connecting legs of a work coil to a portable induction heater also forms part of the present invention. The induction heater is provided with a head which has a portion capable of limited rotation, and a body which may be held by a hand of a user during use of the induction heater. The legs of the work coil may be inserted into apertures on the head. Next, the head portion may be rotated to thereby lock the legs of the work coil to the head. Now, the head portion may again be rotated, in a rotational direction opposite to the locking rotation, enabling the legs to be removed from the head. The output voltage of the work coil may be monitored and, upon detection of a fault condition, the induction heater may be shut down for a predetermined time period. Additionally, the amount of current drawn from the induction heater may be monitored, and upon detection of a fault condition, the induction heater may be shut down for a predetermined time period; the fault condition may now be rechecked and if the fault condition is corrected, the induction heater may be permitted to operate.

The present invention permits the work coil to be rapidly tightened to the portable induction heater, providing a time-savings of at least 50%, and preferably at least about 75%, as compared to the time taken to tighten a work coil using a conventional portable induction heater with thumb screws.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

FIGS. 3-6 are sectional views taken along reference lines 3-3, 4-4, 5-5 and 6-6, respectively, of FIG. 2;

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Set forth below is a description of what are currently believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figures 1, 1A:
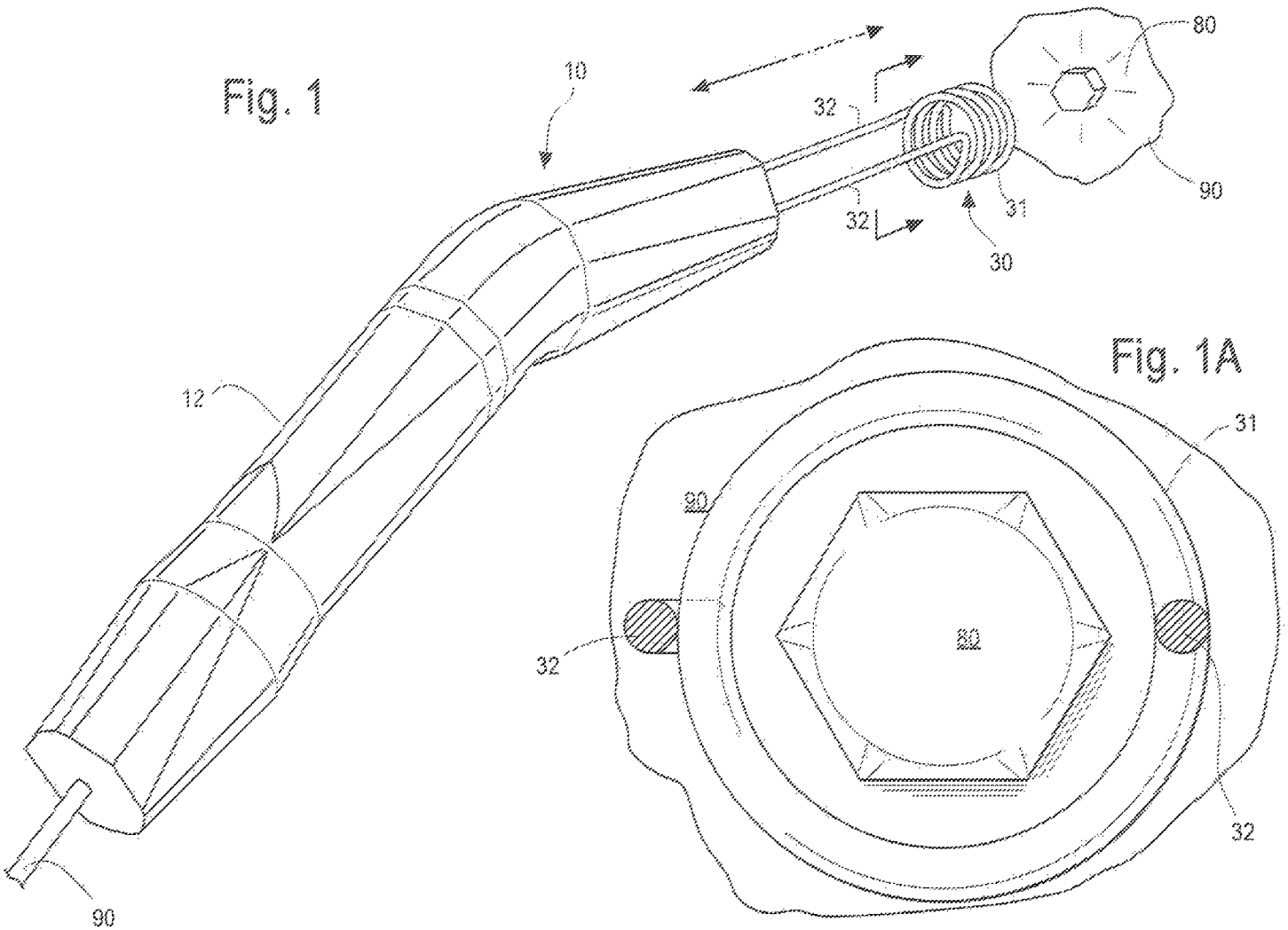
FIG. 1 is a perspective view of a preferred embodiment of a portable induction heater of the present invention, shown engaged to a work coil, for heating a fastener.
FIG. 1A is a schematic view of the fastener adjacent the work coil, and the magnetic field created by the induction heater.

Referring first to FIG. 1, in a particularly preferred embodiment of the present invention, an air-cooled, portable induction heater 10 is shown, for use with a work coil 30 having legs 32. Using induction heater 10 connected to work coil 30, a magnetic field 90 may be generated in the vicinity of work coil 30 to quickly heat material, such as fastener 80, as discussed in U.S. Pat. Nos. 6,563,096 and 6,670,590, and as well known in the art. Coil 30 may be made of round copper wire or another suitable round conductive wire, which may but need not be flattened as described in Applicant's U.S. Ser. No. 14/330,429, referenced above, such that legs 32 may have circular, semi-circular, square or rectangular cross-sections.

Figure 2:
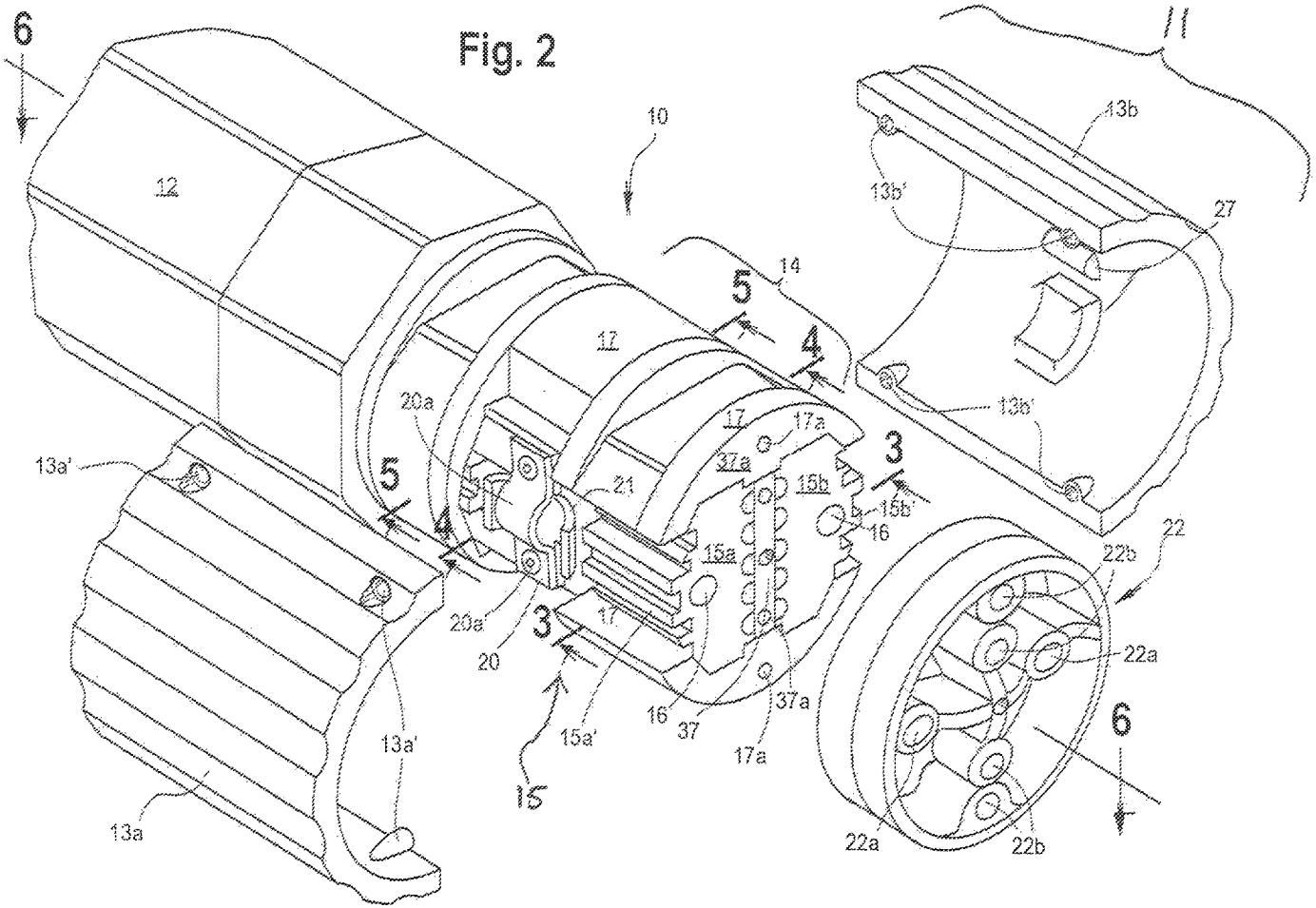
FIG. 2 is a perspective, exploded view of a preferred portable induction heater of the present invention.
Figure 13:
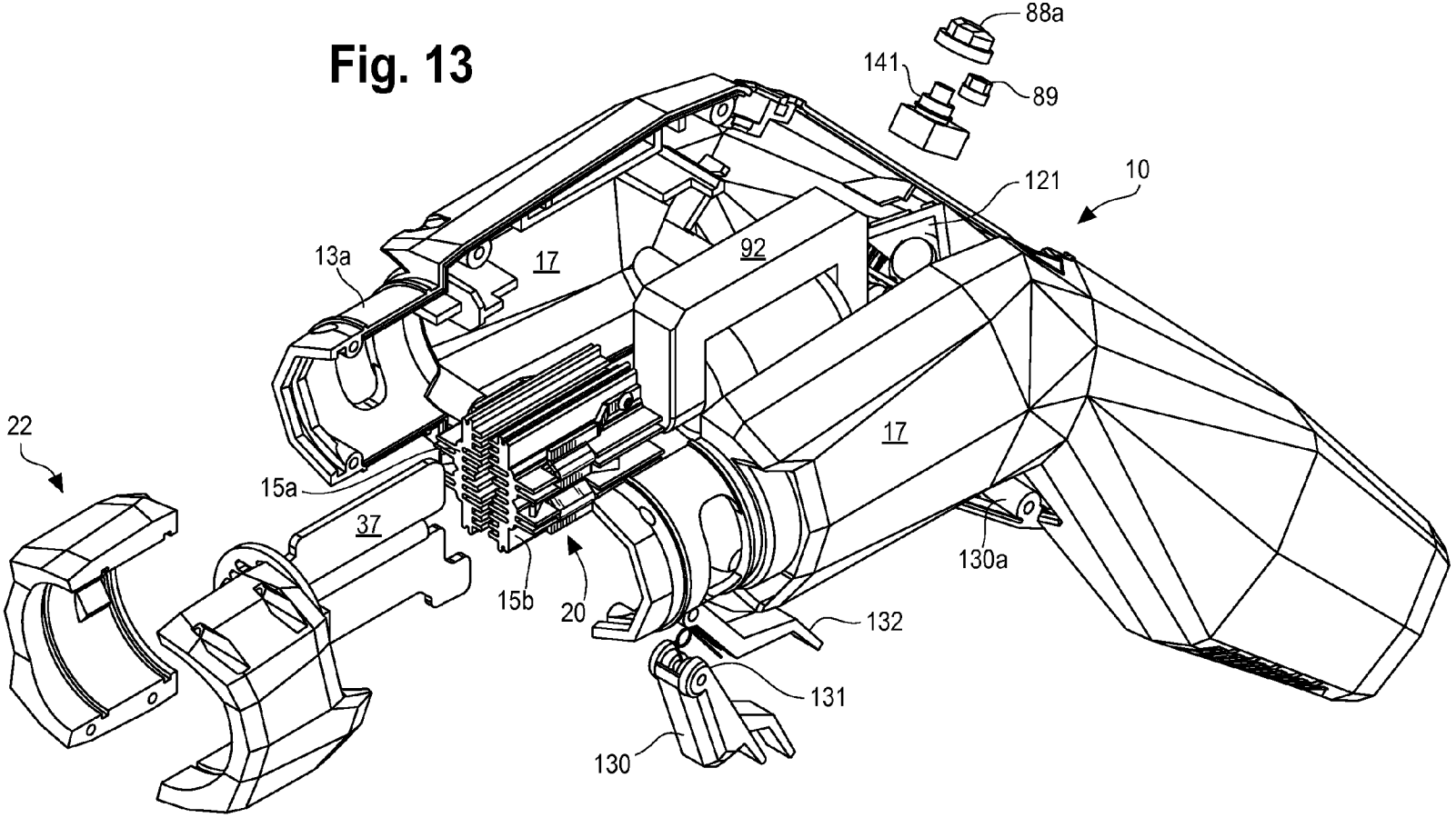
FIG. 13 is an exploded view of the portable induction heater shown in FIG. 12.
Figure 14:
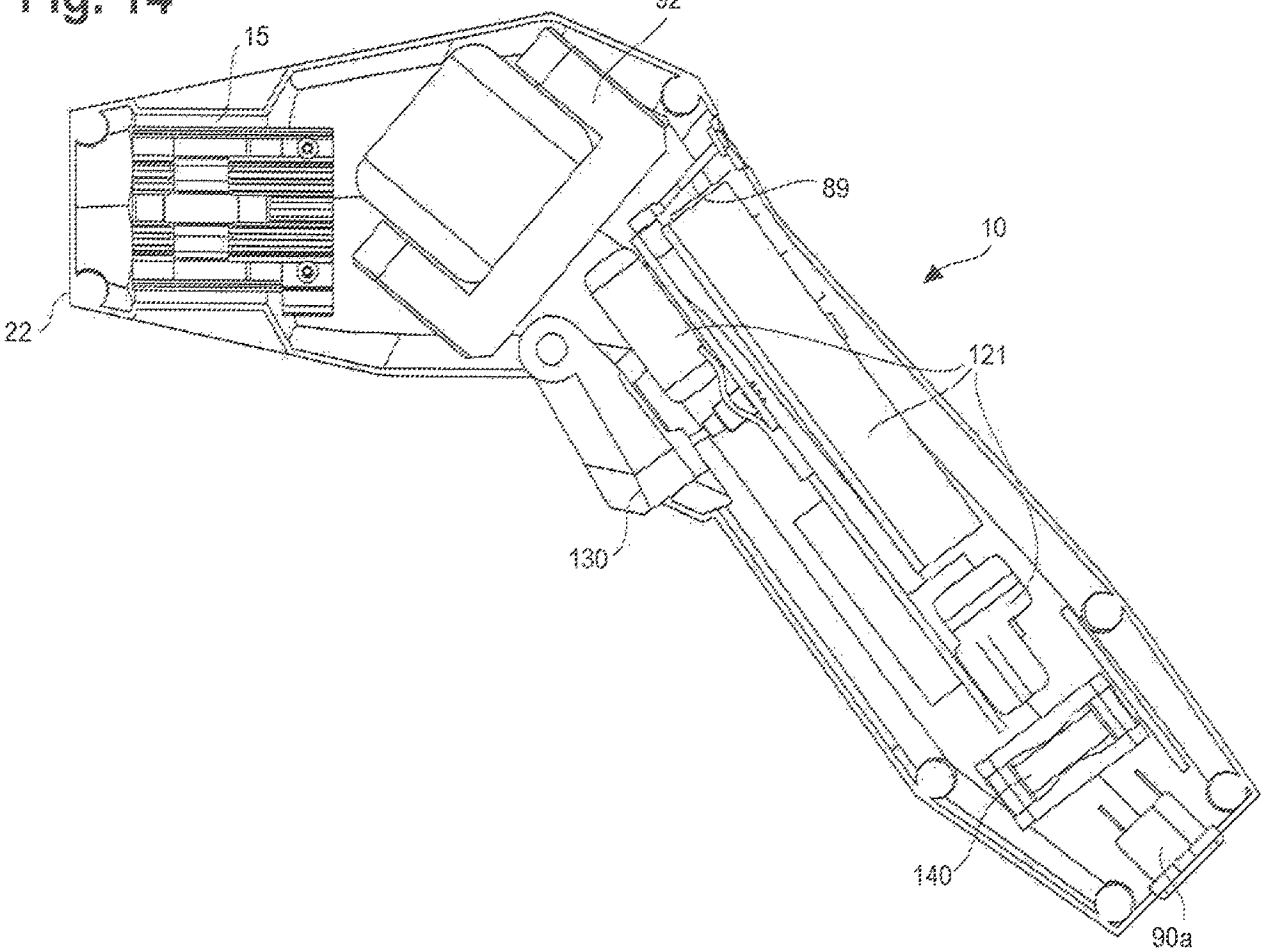
FIG. 14 is a perspective view of the interior of a preferred portable induction heater, which is a slightly different embodiment than that shown in FIG. 13 (e.g., the transformer is canted slightly differently)
Figure 15:
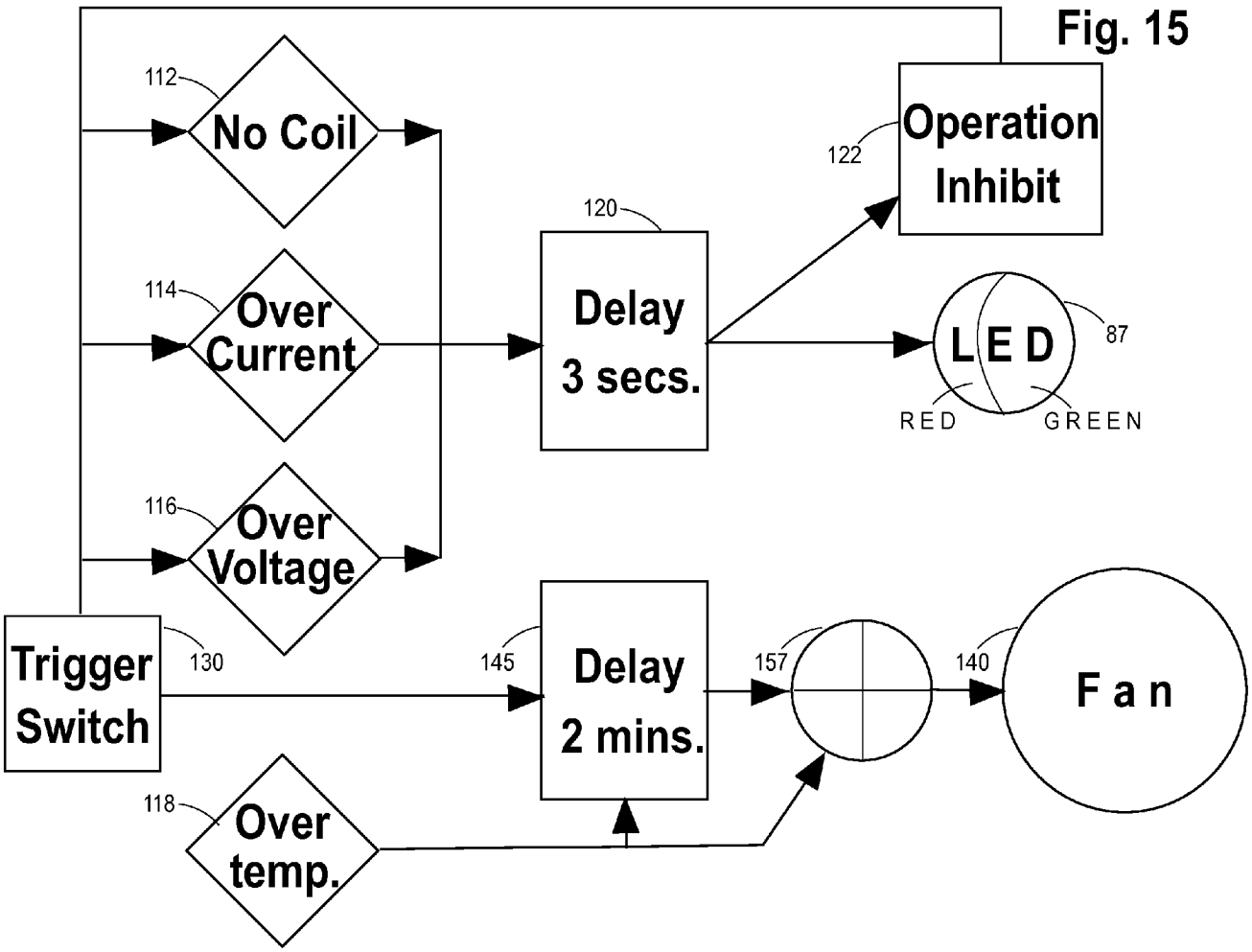
FIG. 15 is a schematic diagram of one preferred fault detection scheme which may be used with a portable induction heater of the present invention.

Referring now to FIG. 2, induction heater 10 may include a hand-held base or body 12, a top interior portion 14 covered by rotatable panels 13*a*, 13*b*, and a top nose portion 22. Top interior portion 14 may include a heat dissipating terminal (HDT) 15, with left and right portions 15*a*, 15*b*, respectively. HDT 1.5 may be extruded out of aluminum, for example. A flexible conductive contactor 20 with a depressible portion 20*a*, which may contact base 21, may be made from a highly conductive metal such as copper, and may be attached to an outer portion of each side of HDT portions 15*a*, 15*b* using fasteners 20*a*. An upper base portion 17 may be made out of hard plastic, for example, to encase the HDT and the isolation transformer 92 (FIGS. 13-14) behind it. Connecting wire (not shown) from an output location on the isolation transformer may be crimped and attached at copper wire holder 94 on the HDT (FIG. 7), by tightening using fastener 94*a*. Power cord 90 including electrical prongs 90*a* may be attached at a rear end of the unit 10 (FIGS. 1, 14). PCB components 121 and fan 140 may be provided as shown in FIG. 14. Switch cover 88*a* (FIG. 13) may be provided adjacent LED 88 (FIG. 15, not shown on FIG. 13).

Referring again to FIG. 2, to secure nose portion 22 to upper base portion 17, fasteners (not shown) may be inserted into nose apertures 22*b* and corresponding apertures 17*a* and 37*a* on upper base portion 17. Nose 22 may provide venting for the unit 10, and also function to hold LED 87 (not shown in FIG. 2, but shown in FIGS. 3-5) in place (for this purpose, a central aperture (not shown) may be provided in nose 22, to allow LED 87 to be visible). Hemispherical outer panels 13*a*, 13*b* may be attached to the upper body of unit 10 using fasteners (not shown) attached through apertures 13*a'* and 13*b'*.

Referring to FIGS. 2-5, heat sink insulator 37 may act: as an insulator between the two HDT portions 15*a*, 15*b*; serve as a conduit for the LED wires (not shown); and also aid in securing isolation transformer 92.

Work coil 30 may be connected and disconnected from portable heater 10 as now discussed. Referring to FIG. 2, legs 32 of work coil 30 may be inserted into first nose apertures 22*a* and then HDT apertures 16.

Referring to FIGS. 2, 7, 13 and 14, each of two legs (not shown) of isolation transformer 92 is connected to one of the (left and right side) copper contactors 20; each of the copper contactors 20 is, in turn, connected to a side (15*a*, 15*b*) of HDT 15. Finally, to complete the connections and actuate the induction heater, each leg 32 of work coil 30 must be connected to one of the copper contactors 20, in operation, and now referring to FIG. 1, with work coil 30 properly seated and tightened to portable induction heater 10, coil 30 is directly fed from an electric power supply (not shown) within heater 10, with electricity provided by power cord 70. Isolation transformer 92 (FIGS. 13-14) is used to take the supply/mains frequency and increase it to a higher frequency, such as about 1-400 kHz, providing power output of about 1-500 kW. A magnetic field is generated in the vicinity closely adjacent the work coil, inducing induction heat within a work piece (e.g., a fastener) adjacent the work coil.

The grip area of induction heater 10, including lower outside body surface 12 and upper body panels 13*a*, 13*b*, may be made of a variety of high-strength materials which can withstand high temperatures, including: nylon; PBT (polybutylene terephthalate); polysulfone; PPS(polyphenylene sulfide); polyetherimide; PEEK(polyetheretherketone); or PVDF (polyvinylidene difluoride).

Figure 7:
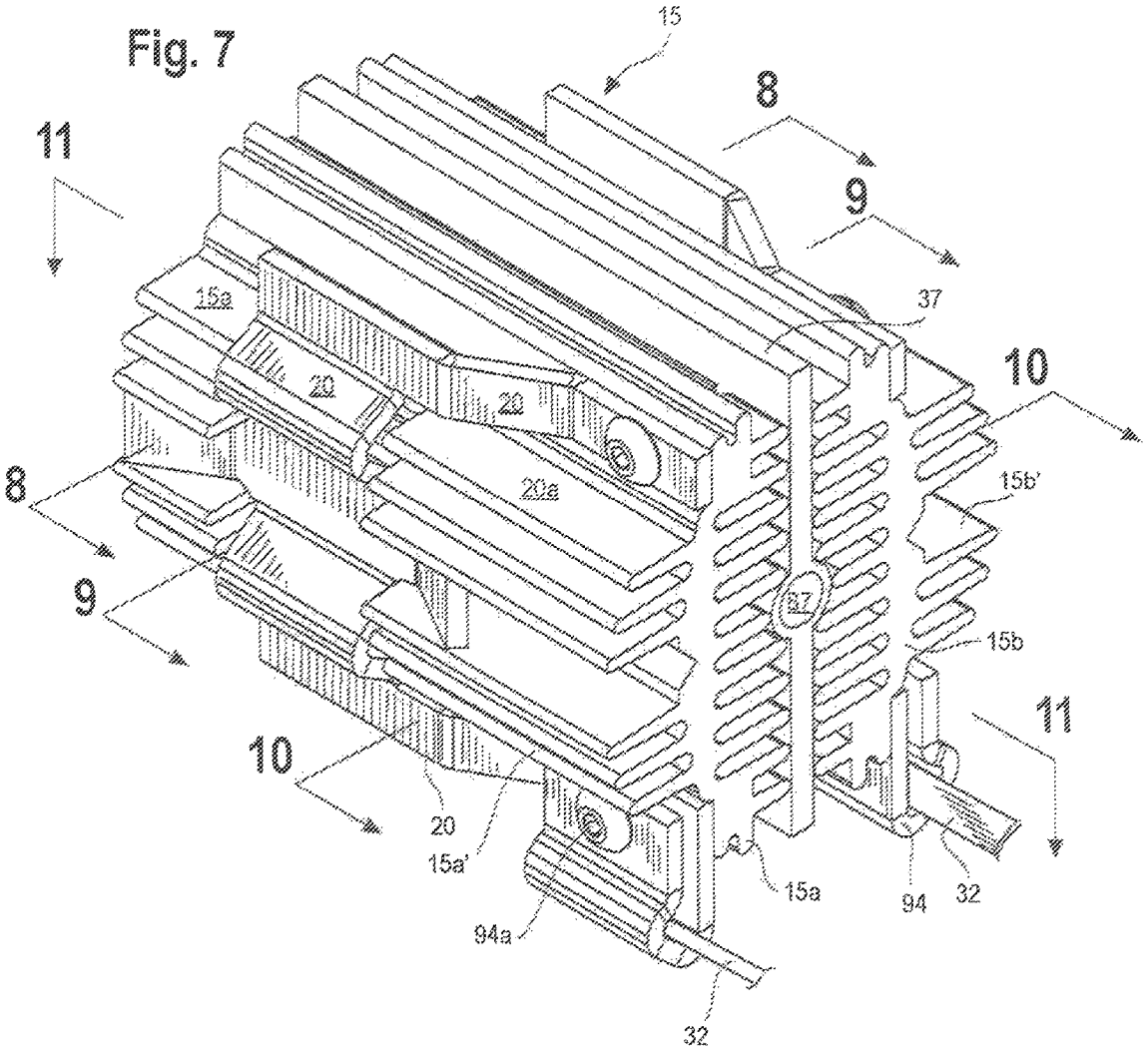
FIG. 7 is a perspective view of an EDT similar to the one shown in FIG. 2, utilizing an alternative contactor embodiment.
Figure 10:
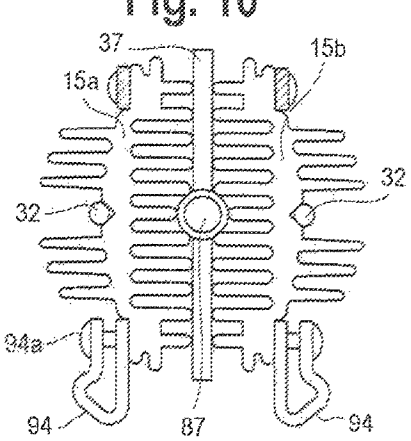
FIGS. 8-11 are sectional views taken along reference lines 8-8, 9-9, 10-10 and 11-11, respectively, of FIG. 7.
Figure 9:
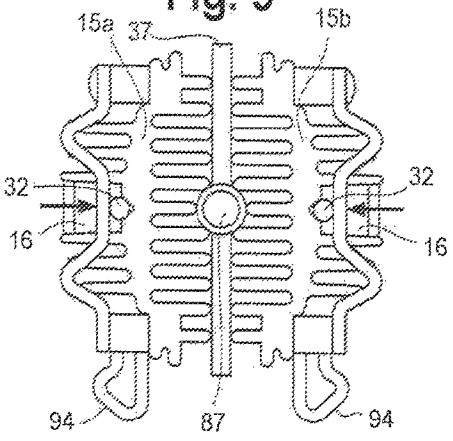
Figure 8:
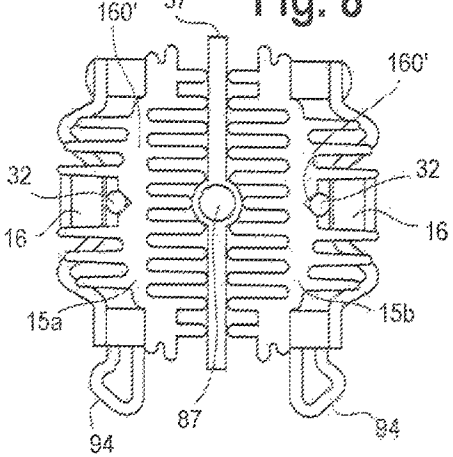
Figure 11:
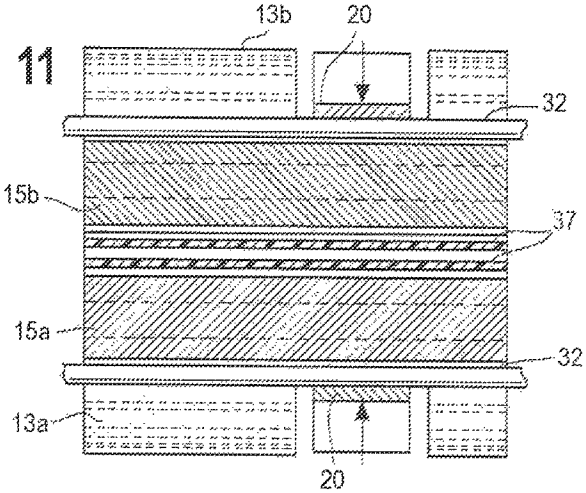

Referring now to FIGS. 2-7, a novel aspect of the present invention concerning engaging and disengaging work coil 30 is now discussed. Outer panels 13 may be provided with the ability to rotate relative to upper body 17 and HDT 15. Collar support 27 (FIG. 2) is shaped and spaced so that when panels 13*a*, 13*b* are rotated, collar support 27 will exert pressure on depressible portion 20*a* of conductive copper contactor 20, both tightening legs 32 between copper portion 20*a* and copper base 21, and also placing legs 32 of work coil 30 in electrical conductivity, via the copper contactor, with HDT 15 and isolation transformer 92. (Collar support 27 also exists on the inside surface of panel 13*a*, although hidden on FIG. 2.) Apertures 16 preferably have V-shaped grooves in at least a portion of their length (see FIGS. 4 and 8-10) as it has been found that this shape is particularly effective at holding legs of different cross-sectional geometries, including round, square and rectangular. As shown at FIGS. 2, 7 and 13, HDT 15 may include serrated fins 15*a'* and 15*b'*.

Panels 13 may be designed so that they have unlimited rotation. Alternatively, it may be preferred to provide panels 13 with limited rotation (by appropriately locating and sizing collar supports 27 in relation to copper contactor 20), so that for example a 20°-30° turn of the panels will cause legs 32 to be tightened or loosened, providing a user with tactile feedback relatively rapidly. In practice, panels 13 may be rotated 20°, for example, legs 32 may be inserted within nose apertures 22*a* and HDT apertures 16, and panels may now be rotated 20° in the opposite direction, to tighten the legs within copper contactor 20.

Figure 12:
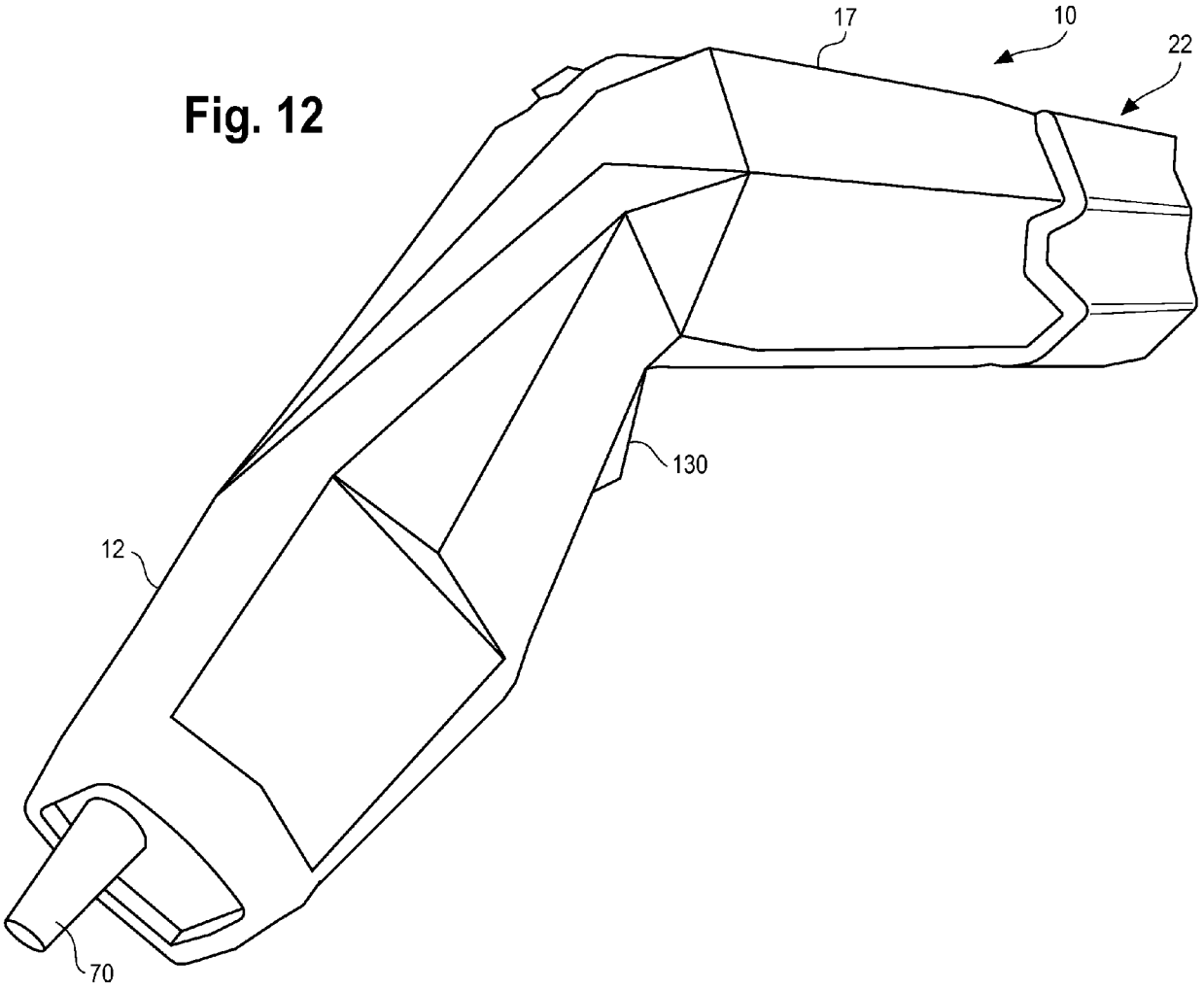
FIG. 12 is a perspective view of an alternative embodiment of a portable induction heater of the present invention.

As suggested in FIG. 2, portable induction heater 10 may be linear in shape. Alternatively, as shown in FIGS. 1, 12 and 13, heater 10 may be angled, such as shown in these drawings. The angled design may be preferred by users working in tight, difficult-to-access areas, or may be preferred simply from an aesthetic standpoint. Note that trigger 130 may be actuated using a torsion spring 131 located between trigger 130 and trigger stop 132; trigger 130 pivots about pivot point 130*a* (FIG. 13).

Referring now to FIGS. 7 and 13, a new method is also provided of securing isolation transformer 92 to work coil 30. In the past, the isolation transformer has been connected to the work coil by connecting the transformer, via a set screw, to the aluminum HDT. There is a resultant heat loss moving from copper to aluminum and back to copper. The new method of the present invention secures isolation transformer 92 directly to copper contactor 20 (by wire, using copper crimping support 94, per FIG. 7, as discussed above); as work coil legs 32 are also connected directly to copper contactor 20, this provides a copper-to-copper-to-copper connection, limiting heat loss.

A way is also provided to detect issues with the work coil such as open coil, no coil present, or a shorted work coil. Currently, users of portable induction heaters used for the automotive aftermarket, for example, rely on the use a good working coil, and properly securing the work coil to the induction heater. If a work coil with breached insulation is used, or a coil is not secured properly ("fault conditions"), this can cause a transient voltage spike across the IGBTs (insulated-gate bipolar resistors) of the unit. A preferred embodiment of the present invention monitors the output voltage and will shut down the output of the induction heater if either of these fault conditions are detected, turning on a fault indicator. The unit may remain in shut-down condition for a period of time so that the condition can be corrected by the user, avoiding damage to the tool. The unit may also enter a fault mode when it detects that a work coil is not present in the tool.

Conventional portable induction heaters used for the automotive aftermarket, for example, also will use as much current as needed to try and heat the load. If too much current is drawn from the unit, this can damage the unit. In a preferred embodiment of the present invention, the induction heater also includes an over-current detector and shut-down feature. The amount of current being used is monitored, and if the unit draws too much current, it will enter into a fault mode. The allowed amount of current can be set to different levels, allowing the induction heater to be customized for various needs.

In a preferred embodiment schematically shown in FIG. 1, a fault-indicator, multi-color (e.g., red, green) LED 88 (preferably different and in addition to LED 87), may be used for both fault indication and normal operation. (Referring to FIGS. 13-14, light pipe 89 may be used to transmit light from fault-indicating LED 88 (shown in FIG. 15 and not shown in FIG. 14, and which may be located on PCB 121) to the outer portion of the housing visible to the user. Referring to FIG. 14, work illumination switch 141 allows the user to keep LED 87 illuminated during heating, or to turn the LED off, at the user's discretion.) In an exemplary operation, the red LED may illuminate under any one of the following fault conditions: 1) if there is not a work coil attached to the tool when the trigger (130) is operated (112); or 2) if an over-current is detected as a result of using the tool for an excessive load (114); 3) if an arc is detected due to a loose connection to the work coil or coil open under use (116); or 4) if the tool heats to the point where the thermal switch opens (118). The green LED may illuminate while the trigger is active and the tool is heating properly.

With this exemplary operation, any event that causes the red LED to illuminate may start a 3-second (120) lock-out of the tool (122). LED 88 may dim as the time elapses. Holding the trigger 130 active during a fault may cause the tool to restart after the delay cycling until the fault is corrected or the trigger is released.

Fan 140 may be permitted to continue to run after trigger 130 is released to aid in thermal cycle time reduction, for up to two minutes (145). Fan 140 may be controlled so that it slows down with time, consuming less current, which becomes advantageous if operating on battery-power. Preferably, fan 140 may stay powered when the thermal switch opens (118) to aid in cooling the tool. Fan 140 may be permitted to run for up to two minutes after the thermal switch resets. (Over temp. 118 and delay (e.g., 2 min.) may meet at junction point 157.)

A separate white LED 87 (FIGS. 8-10) may be used, and may be controlled exclusively by a separate switch 141 (FIG. 13), providing the user with the ability to power on or off the work illumination LED 87, which may be a separate LED from the fault-indicator LED 88. As long as the tool is powered and its internal power supply is operating, white LED 87 may remain illuminated when the switch is on.

If the fuse (not shown) is open, then no power is being provided to the unit, and no LEDs will be permitted to illuminate.

The present invention allows a work coil to be rapidly tightened to a portable induction heater, as compared to a conventional tightening using thumb screws, providing a time saving of at least 50% or more. "Quick timing" comparison tests were performed. Using both hands to tighten thumbscrews, it took an average of about 8.5 seconds to tighten a work coil to a conventional portable induction heater. Using the present "twist-lock" invention, this was accomplished in about 2 seconds, providing a time savings of about 75%. If only one hand is used to tighten both thumbscrews, tightening a work coil took an average of about 13.30 seconds, while one hand using the "twist-lock" feature could accomplish this in about 2 seconds, yielding a time savings of about 85%.

The above description is not intended to limit the meaning of the words used in the following claims that define the invention. For example, while various preferred and less preferred embodiments have been described above, persons of ordinary skill in the art will understand that a variety of other designs still falling within the scope of the following claims may be envisioned and used, it is contemplated that future modifications in structure, function or result will exist that are not substantial changes and that all such insubstantial changes in what is claimed are intended to be covered by the claims.

We claim:

1. A portable induction heater, comprising:

a body which may be held by a hand of the operator during use of the portable induction heater;

a work coil comprising a coil portion and two legs; and a head capable of being attachably and detachably connected to a work coil, wherein the head comprises apertures configured for receiving the legs of the work coil;

wherein the head comprises a heat dissipating terminal, a nose portion, and a collar at least partially encompassing an outside portion of the heat dissipating terminal and configured for limited rotation about at least a portion of the head;

wherein an inside surface of the collar includes two or more inwardly-projecting nubs, each positioned to push against a different depressible portion of two electrical contactors upon rotation of the collar, and wherein the contactors are located on an outside portion of the head, with each contactor being in selectable electrical conduction with a different leg of the work coil;

whereby upon insertion of the legs of the work coil into the apertures, limited rotational movement of the collar simultaneously causes each of the two legs of the work coil to be locked in place between the two contactors and the heat dissipating terminal, wherein the two legs are in electrical conduction with the heat dissipating terminal, and further rotational movement of the collar breaks the electrical conduction between the two legs and the heat dissipating terminal.

2. The portable induction heater of claim 1, wherein the contactors comprise two copper contactors, and wherein one or more inner surfaces of the collar contact and bend each of the two copper contactors during rotation of the collar, causing each of the two legs of the work coil to be locked in place against each of the two corresponding copper contactors within the head, and providing positive feedback to the user that the legs are locked in place.

3. The portable induction heater of claim 2, further comprising an isolation transformer in electrical connection with the heat dissipating terminal.

4. The portable induction heater of claim 3, wherein the heat dissipating terminal comprises two separate portions, and wherein each of the two copper contactors is directly connected to one of the two portions of the heat dissipating terminal.

5. The portable induction heater of claim 1, wherein the portable induction heater comprises an air-cooled induction heater.

6. The portable induction heater of claim 1, wherein the heat dissipating terminal comprises extruded aluminum.

7. The portable induction heater of claim 1, wherein non-circular grooves on the portable induction heater may be used to accept the legs of the work coil.

8. The portable induction heater of claim 7, wherein the heat dissipating terminal has fins with serrations, and wherein the non-circular grooves do not have serrations.

9. The portable induction heater of claim 7, wherein the non-circular grooves comprise generally V-shaped grooves.

10. The portable induction heater of claim 1, wherein the portable induction heater is used for automotive applications.

11. The portable induction heater of claim 1, wherein the portable induction heater is used for industrial or maritime applications.

12. The portable induction heater of claim 1, wherein the heat dissipating terminal comprising two separate portions separated by a heat sink insulator.

* * * * *